United States Patent [19]

Costa et al.

[11] Patent Number: 4,637,601

[45] Date of Patent: Jan. 20, 1987

[54] CASSETTE FOR A SHEET FEED DEVICE

[75] Inventors: Jorge Costa; Wolfgang Reichel, both of Yverdon, Switzerland

[73] Assignee: Hermes Precisa International S.A., Switzerland

[21] Appl. No.: 616,147

[22] Filed: Jun. 1, 1984

[30] Foreign Application Priority Data

Jun. 3, 1983 [CH] Switzerland ..... 3058/83

[51] Int. Cl.[4] ..... B65H 1/12

[52] U.S. Cl. ..... 271/160; 271/127; 271/164

[58] Field of Search ..... 271/9, 24, 126, 127, 271/145, 147, 160–162, 170, 171, 184, 164, 225; 221/198, 252

[56] References Cited

U.S. PATENT DOCUMENTS

| | | | |
|---|---|---|---|
| 1,964,498 | 6/1934 | Brasseur | 271/161 |
| 3,321,078 | 5/1967 | Treiber | 271/161 |
| 3,687,448 | 8/1972 | Vera | 271/161 |
| 3,857,558 | 12/1974 | Patel | 271/127 |
| 4,007,925 | 2/1977 | Deryke et al. | 271/160 |
| 4,280,692 | 7/1981 | Hutchinson et al. | 271/160 |
| 4,444,386 | 4/1984 | Murata et al. | 271/127 |
| 4,475,731 | 10/1984 | Wood | 271/164 |

FOREIGN PATENT DOCUMENTS

| | | | |
|---|---|---|---|
| 0052833 | 4/1980 | Japan | 271/160 |
| 0107340 | 7/1982 | Japan | 271/170 |

*Primary Examiner*—George E. A. Halvosa
*Assistant Examiner*—James E. Barlow

[57] ABSTRACT

The cassette comprises a bottom (25) and four side walls (26 to 29) comprising on their upper edge holding elements (14) for the sheets. These sheets are placed on a support plate (41) held near one of the corners (33) in contact with the bottom (25). Three springs (44 to 46) pull the plate (41) in the direction of the holding elements (14). A locking mechanism (50) consists of a sliding part (51) comprising near its ends two openings (54) able to work with two flathead pins (52) solid with the plate (41) to hold the latter against the bottom (25) in the vicinity either of the corner (31), or of the diametrically opposite corner (32). The same cassette can thus be introduced in the lengthwise or widthwise direction, which makes possible a saving in cassettes and in sheets.

8 Claims, 6 Drawing Figures

CASSETTE FOR A SHEET FEED DEVICE

This invention has as its object a cassette for a sheet feed device for a printer, intended to hold a stack of sheets for printing, comprising a rectangular-shaped bottom and side walls having on their upper edge holding elements for holding the sheets in the cassette, the cassette comprising elastic elements that pull the sheets by a support plate approximately along a first side of the cassette against the holding elements so that the sheets work, on this side, elastically with a mechanism for removal and transport of the feed device.

Cassettes of this type, described for example in patent applications DE-28 16 448 and DE-30 31 869, are known. These cassettes can be introduced into the feed device in only one direction. When the user desires to write in a direction perpendicular to this direction, the sheets must be loaded into another cassette comprising a different arrangement of its constituent elements.

The invention has as its object to eliminate this drawback by creating a cassette that can be introduced into the device in two perpendicular directions. For this purpose, this cassette comprises elastic elements that can pull the sheets along a second side, adjacent to the first, against said holding elements and a locking mechanism intended to hold the support plate against the bottom approximately in the vicinity either of the side opposite the first side of the cassette, when the latter is introduced by this first side into the printer, or of the side opposite the second side of the cassette when the latter is introduced by this second side.

The accompanying drawing shows, by way of example, an embodiment of the cassette, object of the invention.

Figure 1:
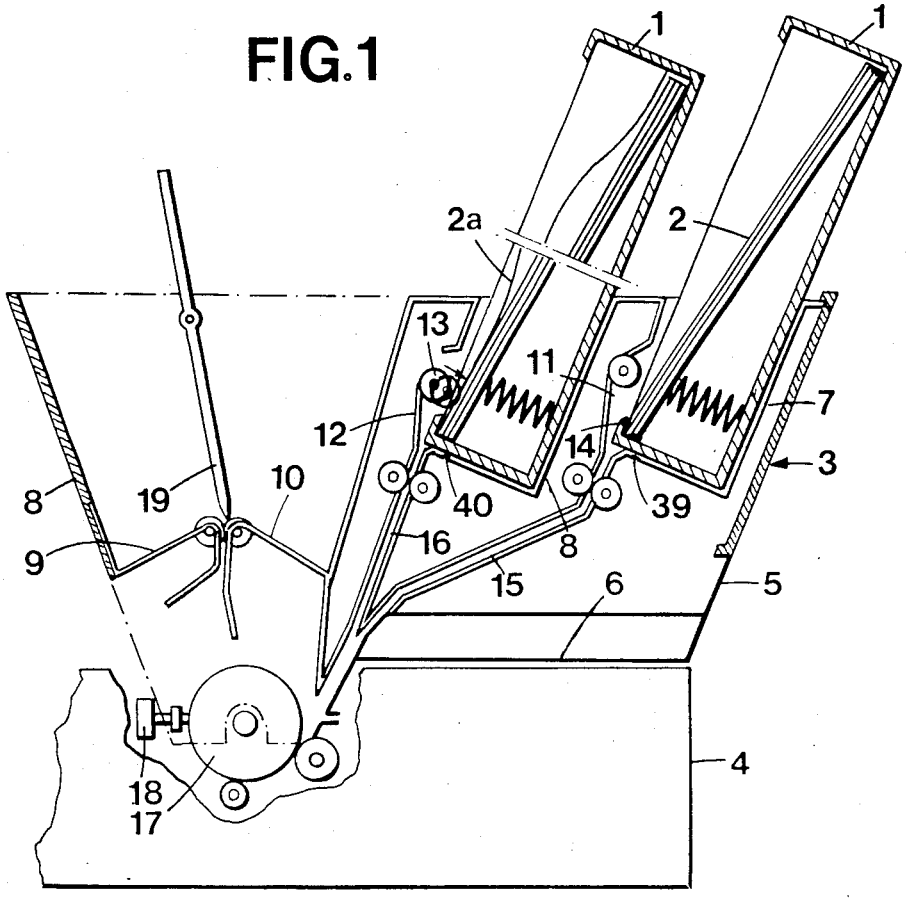
FIG. 1 illustrates, in a side view, a sheet feed device mounted on a printer.

Sheet feed device 3, illustrated in FIG. 1, is placed on a printer 4. This device comprises a frame 5 whose base 6 rests on the back part of printer 4, supports 7 and 8 on which cassettes 1 are placed and sites 9 and 10 at which the printed sheets are stacked. Cassettes 1, which are the object of this invention, hold a stack of sheets 2. One of the cassettes is placed in the lengthwise direction on support 8, while the other cassette, identical with the first, is placed in the widthwise direction on support 7.

A removal and transport mechanism 11, 12 is associated with each of support 7, 8, and comprise a roller 13 that can come in contact with the top sheet 2*a* of the stack. This roller 13 is driven by a drive mechanism, not shown, to move sheet 2*a* by friction upward to disengage it from holding elements 14 of cassette 1 and then to transport it downward over these elements 14. The sheet is then introduced through channels 15 or 16 into the printer to be positioned on platen 17 opposite printing device 18. After having been printed, sheets 2 are transferred to one or the other of sites 9 and 10 according to the position of separation wall 19. A more detailed description of this feed device is provided in UK patent application No. 2,140,784A and EP patent application No. 0128866.

Figure 6:
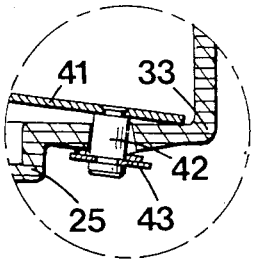
Figure 3:
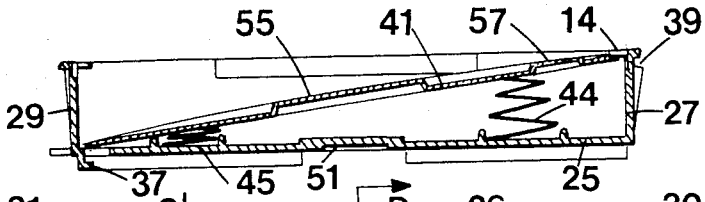
FIG. 3 illustrates a section view along C—C of FIG. 2.
Figure 2:
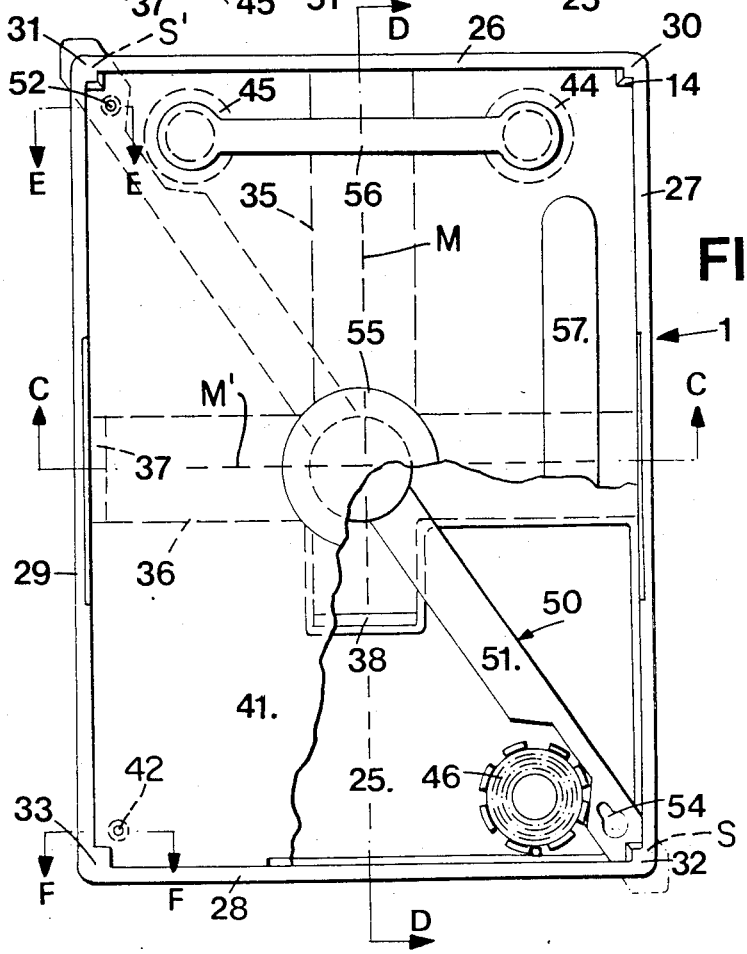
FIG. 2 is a plan view of the cassette, object of the invention, the cassette being set for an introduction in the direction of the width.
Figure 4:
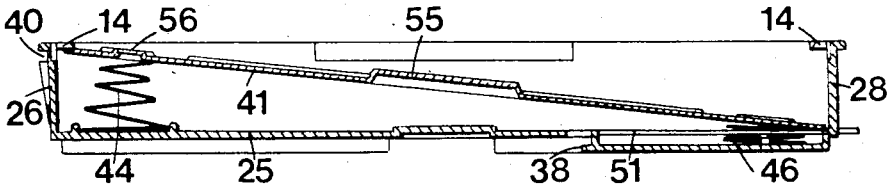
FIG. 4 illustrates a section view along D—D of FIG. 3, the cassette being set for an introduction in the direction of the length.

Cassette 1 illustrated in FIGS. 2 to 4 comprises a rectangular-shaped bottom 25 and side walls 26 to 29, which comprise on their upper edge holding elements 14 consisting of rims located in the four corners 30 to 33 of cassette 1. The cassette and its bottom, along with any stack of sheets disposed therein, will be seen to define a major axis parallel the length of the cassette and sheets, as shown by the line M, as well as a minor axis parallel the width of the cassette and sheets, as represented by the line M′ in FIG. 2. Cassette 1 is able to be introduced into the feed device, either along its first shortest side 26 on support 8, or along the adjacent first longest side 27 on support 7 respectively in a direction parallel to the major and minor axes M, M′. Cooperating with the first shortest side 26 and first longest side 27 are opposite and parallel second shortest side 28 and second longest side 29, respectively. The bottom 25 is provided, for this purpose, with two slides 35, 36 intended to guide the introduction of cassette 1 into feed device 3. Hooking elements 37 to 40 are placed on slides 35 and 36 and on walls 26 and 27 and work, during the introduction of the cassette in the feed device, with corresponding elements so as to lock cassette 1 into an exact position. Sheets 2 are placed inside the cassette on a support plate 41. This plate 41 is held in the vicinity of one of the corners 33 approximately in contact with the bottom of cassette 1. As illustrated in FIG. 6, the cassette comprises for this purpose a fastening element consisting, for example, of a pin 42 solid with plate 41 passing through bottom 25 through a hole and held in position by a spring washer 43.

In the vicinity of the three other corners, the cassette comprises three helical springs 44 to 46 located between bottom 25 and plate 41 so as to usage the latter in the direction of holding elements 14.

Figure 5:
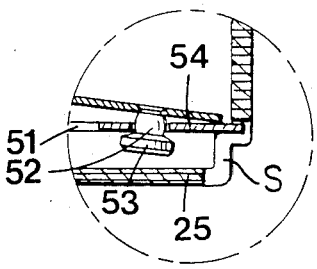
FIGS. 5 and 6 show section views in detail along E—E, or F—F.

Cassette 1 is further provided with a locking mechanism 50 made to lock support plate 41 alternatively in the vicinity of diametrically opposed corners 31 or 32 against the action of spring 45, or 46 in a position where this plate 41 is approximately in contact with bottom 25. This mechanism consists of a sliding part or list 51 that diagonally passes through cassette 1 and that slides in two slots S, S′ provided in the side walls at corners 31 and 32 in the vicinity of bottom 25 of cassette 1. With reference to FIG. 5, plate 41 is provided, near the corners 31, 32, with two retainer elements or flathead pins 52 able to be engaged in openings or hooking elements 54 provided on list or sliding part 51 and to be held by the edges of this opening 54 comprising a width portion less than the section of the head 53 of the pin. List 51 has a length slightly larger than the diagonal of cassette 1 to be able to be moved from the outside of cassette 1 to lock corner 32 of plate 41 against the bottom when it is desired to introduce the sheets in the lengthwise direction along the major axes M, as illustrated in FIG. 4. On the other hand, plate 41 is held in its low position near the diagonally opposed corner 31 when the cassette is introduced in the widthwise direction along the minor axis M′ (FIG. 2 and 3).

Thus, spring 44 remains constantly in an active or expanded position, while one of the two other springs 45 or 46 is locked in compressed position. With reference to FIG. 1, sheets 2 are therefore pressed elastically along the lower edge of cassette 1 against holding elements 14 to work along this side with roller 13 of the removal and transport mechanism.

Support plate 41 comprises a curved central part 55 and two other curved portions 56 and 57 located in the vicinity of sides 26 and 27 in the vicinity of which roller 13 works with sheet *2a*. These curved portions facilitate the disengagement of top sheet *2a* under the holding elements.

Because the same cassette can be introduced in two perpendicular directions into the feed device, a saving in cassettes and in sheets can be made.

We claim:

1. A cassette intended to hold a stack of sheets to be printed, said cassette and sheets of rectangular configuration and having major and minor axes respectively extending along their length and width, said cassette comprising a rectangular shaped bottom and first and second longest side walls parallel to said major axis and first and second shortest side walls parallel to said minor axis, said cassette adapted to be selectively inserted into a sheet feed device or printer to deliver said sheets thereto in a direction parallel either said major or said minor axis, upper edge holding elements disposed on said first longest side wall and said first shortest side wall to hold the sheets in the cassette, a support plate within said cassette supporting the stack of sheets, selected ones of a plurality of elastic elements pushing said support plate and sheets to urge a first edge of the sheets against said holding elements on said first shortest side wall so that the sheets elastically engage at said first shortest side wall with a removal and transport mechanism of the sheet feed device, selected ones of a plurality of elastic elements adapted to push said support plate and sheets to urge a second edge of the sheets against the holding elements on said first longest side wall so that the sheets elastically engage at said first longest side wall with a removal and transport mechanism of the sheet feed device, and a locking mechanism intended to hold said support plate against the bottom approximately in the vicinity of either said second shortest side wall when the sheets are to be delivered in a direction parallel to said major axis or in the vicinity of said second longest side wall when the sheets are to be delivered in a direction parallel to said minor axis.

2. A cassette according to claim 1, including four corners, a fastening element in the vicinity of a first corner located between said second longest and second shortest side walls holding said support plate in a position approximately in contact with said bottom of the cassette, said elastic elements including springs placed between said bottom and said support plate in the vicinity of the three other ones of said four corners of the cassette, said springs being intended to push said support plate toward said upper edge holding elements and wherein said locking mechanism is adapted to hold said support plate against the bottom approximately in the vicinity of a second corner located between said second shortest and first longest side wall against the action of the spring located in the vicinity of said second corner, when the sheets are to be delivered in a direction parallel to said major axis, and wherein said locking mechanism is adapted to hold said support plate against the bottom approximately in the vicinity of a third corner located between said first shortest and said second longest side wall against the action of the spring located in the vicinity of said third corner, when the sheets are to be delivered in a direction parallel to said minor axis.

3. A cassette according to claim 2, wherein said locking mechanism comprises a sliding part placed diagonally near said bottom between said second and third corners, said side walls in the vicinity of said second and third corners each having a slot, said sliding part engageable with said slots and including hooking elements in the vicinity of each of said second and third corners, retainer elements on said support plate adjacent said hooking elements of the sliding part, said sliding part shiftably to selectively engage one said hooking element with one said adjacent retainer element to hold selectively a corner of the support plate against the action of the spring placed in the vicinity of said second or third corner.

4. A cassette according to claim 1, wherein the support plate comprises two curved portions intended to facilitate the disengagement of the top sheet under the upper edge holding elements by said removal and transport mechanism.

5. A cassette according to claim 4, wherein the central portion of the support plate is curved.

6. A cassette according to claim 4, wherein said two curved portions are located in the vicinity of said first shortest and first longest side walls of the cassette.

7. A cassette according to claim 1, wherein the bottom of the cassette comprises, perpendicular to said first shortest and first longest side walls, at least a slide intended to guide the introduction of the cassette into the sheet feed device.

8. Cassette according to claim 1, including elements intended to lock the cassette in a predetermined position when it is introduced into the feed device.

* * * * *